United States Patent [19]

Taub

[11] Patent Number: 4,694,962

[45] Date of Patent: Sep. 22, 1987

[54] STANDARD DIMENSION PALLET ASSEMBLY FORMED OF SEPARATE ABUTTED SEGMENTS

[76] Inventor: Ronald H. Taub, John Hancock Bldg., 175 E. Delaware, Chicago, Ill. 60035

[21] Appl. No.: 742,992

[22] Filed: Jun. 10, 1985

[51] Int. Cl.[4] ..... B65D 19/26

[52] U.S. Cl. ..... 206/600; 108/54.1; 108/56.1; 108/114; 206/386

[58] Field of Search ..... 108/51.1, 51.3, 52.1, 108/53.1, 53.3, 53.5, 54.1, 55.1, 55.3, 55.5, 56.1, 56.3, 57.1, 114; 206/595-600, 497, 386

[56] References Cited

U.S. PATENT DOCUMENTS

| | | | |
|---|---|---|---|
| 2,058,716 | 10/1936 | Pagel | 206/597 |
| 2,664,813 | 1/1954 | Rose | 206/597 |
| 2,919,875 | 1/1960 | Mendel | 108/55.5 |
| 3,077,982 | 2/1963 | Berner | 206/386 |
| 3,164,252 | 1/1965 | Hosbein | 206/597 |
| 3,567,068 | 3/1971 | Carfizzi et al. | 108/56.3 |
| 3,659,707 | 5/1972 | Nilsson et al. | 206/386 |
| 3,977,333 | 8/1976 | Phillips | 108/54.1 |
| 3,986,611 | 10/1976 | Dreher | 206/497 |
| 4,100,859 | 7/1978 | Clark, Jr. | 206/600 |
| 4,253,570 | 3/1981 | O'Connor et al. | 206/386 |

FOREIGN PATENT DOCUMENTS

| | | | |
|---|---|---|---|
| 2463068 | 3/1981 | France | 108/54.1 |
| 0912051 | 12/1962 | United Kingdom | 206/386 |

*Primary Examiner*—William Price
*Assistant Examiner*—Jimmy G. Foster
*Attorney, Agent, or Firm*—Norman Lettvin

[57] ABSTRACT

Aliquot segments of a product transport pallet are maintained assembled to form a pallet assembly of a standard size by rigid members and metallic bands, by mutual interengagement of abutting portions of the segments or by rigid members and clips to enable the segments and a divisible cargo of products contained on the pallet to be readily separated or split into segments for ease of transport and/or display at a point of storage or sale.

11 Claims, 14 Drawing Figures

FIG. 1
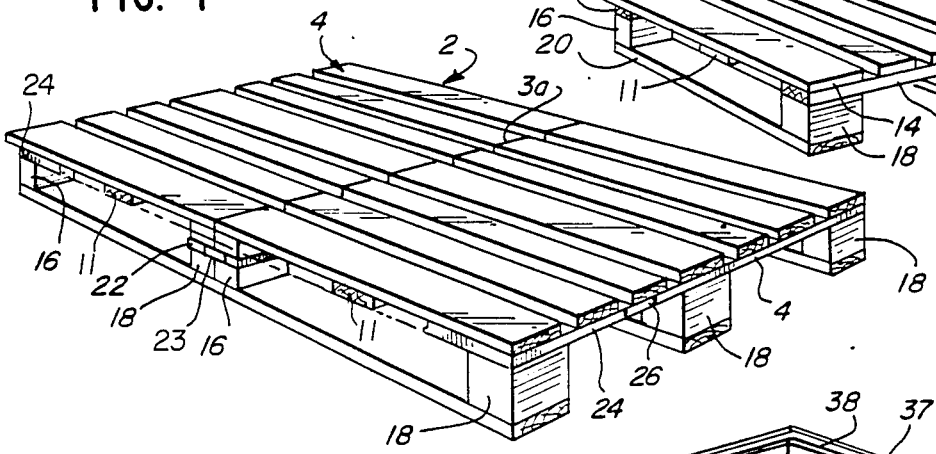
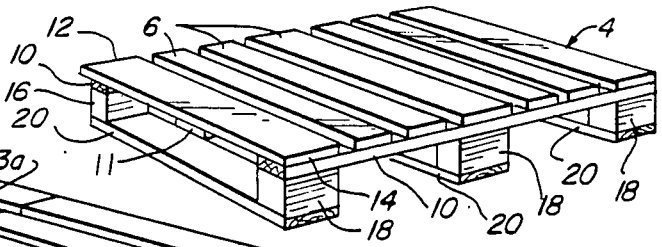
FIG. 2
FIG. 3
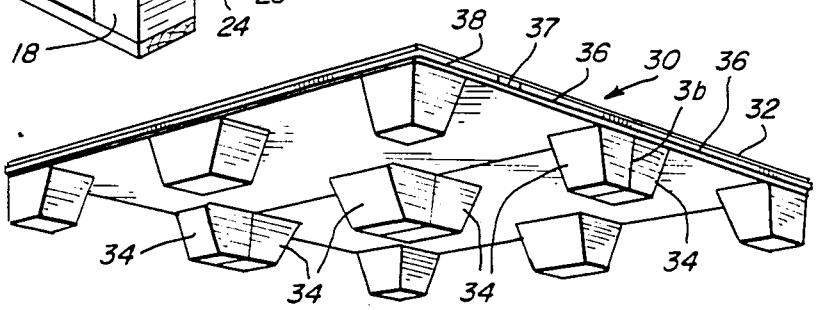
FIG. 4
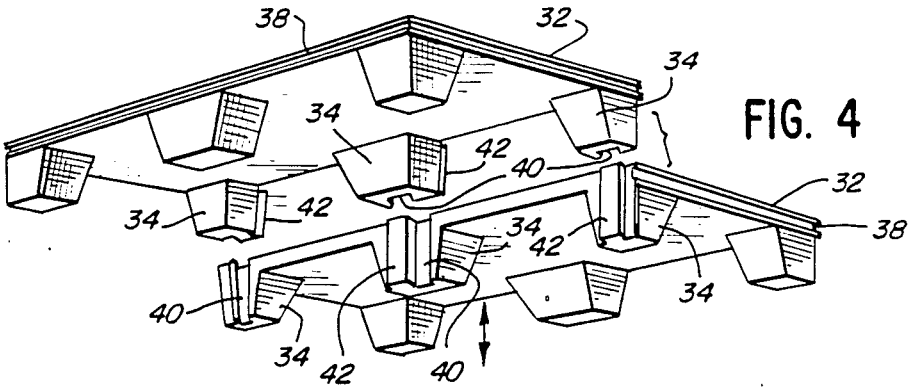
FIG. 5
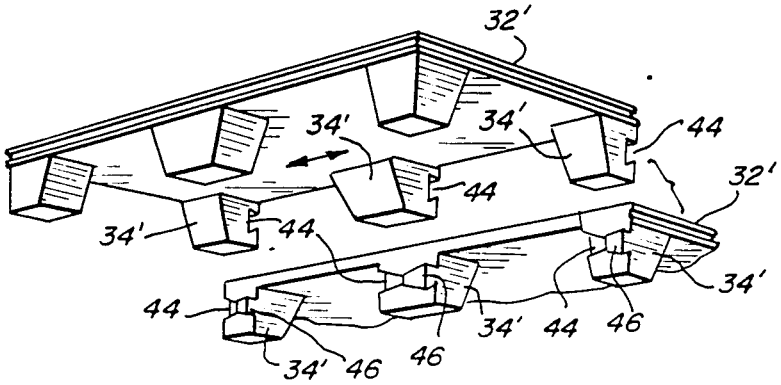

FIG. 6
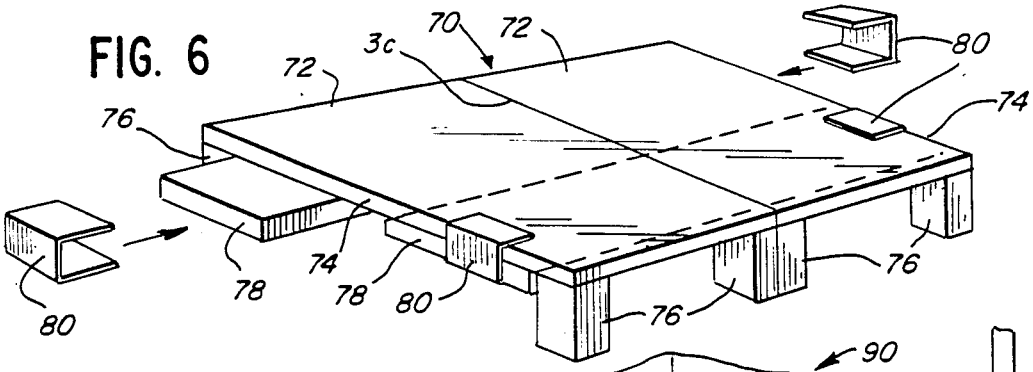
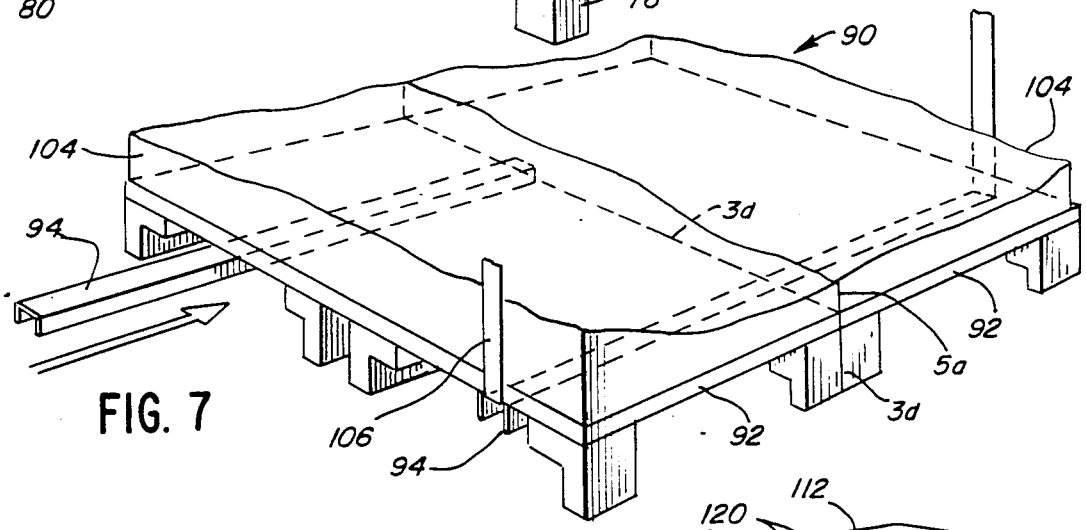
FIG. 7
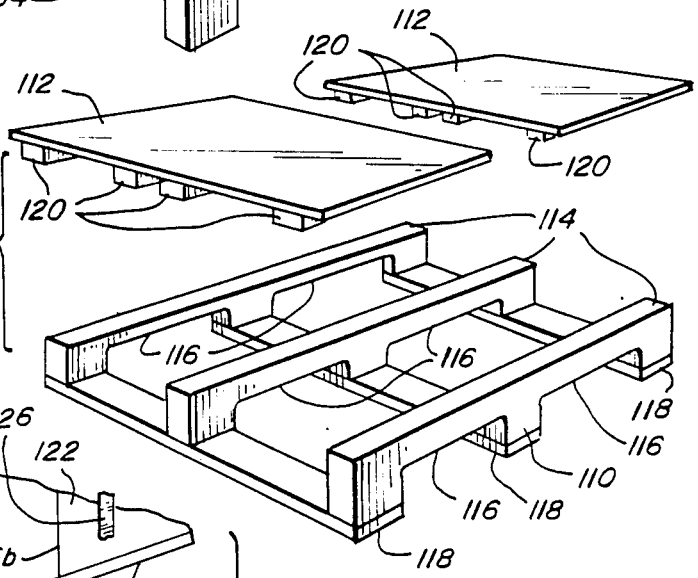
FIG. 8
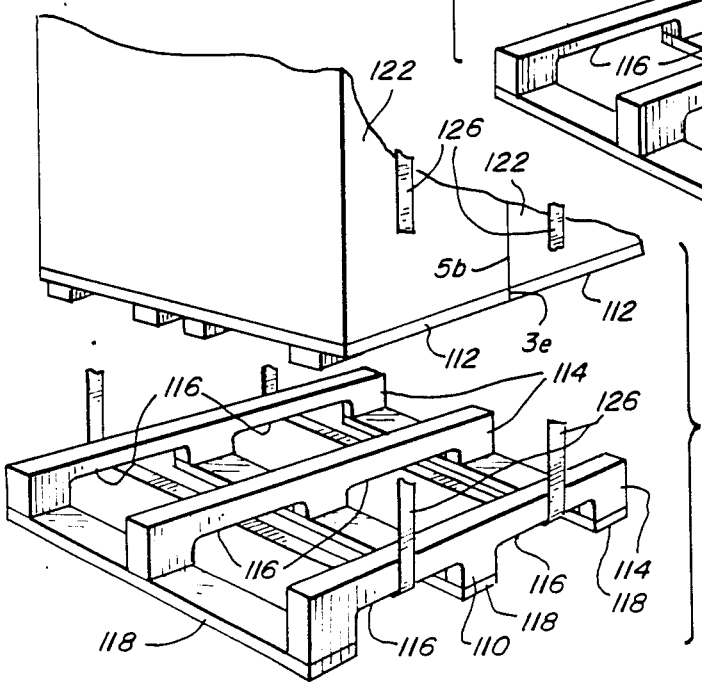
FIG. 9

STANDARD DIMENSION PALLET ASSEMBLY FORMED OF SEPARATE ABUTTED SEGMENTS

PALLETIZED PRODUCT DISPLAYS

This invention relates to palletized product displays, and more particularly to such a display that is constructed to provide sub-portions, such as aliquot portions, of a standard palletized product display.

BACKGROUND OF INVENTION

It has long been known to palletize products and to deliver such palletized products as a unit to warehouses, or retailing stores, for retailing presentation of the products to the public.

Standard pallets, or skids, upon which articles are usually stacked, for convenience of assembly and shipment, are usually of a dimension of 48"×40".

New trends in the retailing of consumer products have provided opportunity for larger displays of consumer products in retailing stores. Increased retailer competition has resulted in a trend, or demand, for lower costs to those retailers that are of smaller size than those retailers who have available both the space and economic power to receive and display standard sized pallets upon which consumer products are stacked for offering to prospective purchasers.

There exists a need to supply smaller retailers with palletized consumer goods provided upon pallet segments that are an aliquot portion, such as ½ or ¼, of the standard palletized quantity of consumer type goods, so that the smaller retailer may obtain the economic benefits of offering larger displays of consumer products in his store more competitively with those retailers that have available both large space and economic power.

SUMMARY OF THE INVENTION

Palletization of consumer type goods is effected upon aliquot segments of a standard sized pallet, wherein each such segment is constructed to serve the support function of a pallet. The split loads of a standard pallet are arranged to be supported on the said segments of a standard pallet, with separable means being provided for securing the pallet segments together, so that the pallet segments, when secured together, serve as a standard sized pallet when loading the pallet at the point from whence shipped, but permitting the loading for the standardized pallet to be readily split for display of goods on one or more pallet portions as may be required by the smaller retailer.

To achieve the benefit of existing standard sized pallets at the point of assembly, while providing the benefit of offering for display only an aliquot portion of a loaded standard sized pallet, the support for the goods is formed with adjacent intermediate support legs that are separably interlocked, or banded together by severable horizontal banding means, to assemble the portions of the pallet as a standardized pallet, while the planar support surface for the goods remains of the standardized pallet size and shape.

PRIOR ART

Others have recognized the need to increase the versatility of pallets. Thus, U.S. Pat. No. 3,651,769 seeks to increase pallet versatility by use of four different sized and shaped members, namely main support members 1 with joining holes 7 and 8 therethrough, the holes being adapted to receive therethrough connectors 14 with a sliding fit, and using extender members 3 and butt extender members 4. The arrangement of parts permits the pallet to be built up to one of the twelve sizes listed in Col. 1, lines 36–42.

U.S. Pat. No. 3,650,224 proposes making pallets in sections, with dovetailed, vertically extending, joint portions that extend vertically through the good-supporting surface of the pallet, so that if one section of the pallet is damaged, the damaged section may be removed and a new section substituted.

U.S. Pat. No. 4,062,301 discloses a pallet preferably formed of metal, and with longitudinal and transverse extension members that may be assembled or disassembled in the field by telescoping portions provided on the pallet edge and on the extension members. In addition to the increased expense by use of metal parts, whose potential damage may interfere with utility and ability to telescope, the pallet's extension members are not constructed to be separately load bearing to serve as separable product supporting segments of a standard sized pallet.

U.S. Pat. No. 4,287,991 discloses a modularized unit load coupled with a frangible, and hence not re-usable, pallet that does not serve as a standard re-usable pallet support.

OBJECT OF THE INVENTION

An object of this invention is to provide a horizontal, load supporting pallet that serves as the lowermost section of a palletized load of goods. The pallet is formed of aliquot segments positioned adjacent each other in an abutted relationship. Each pallet segment includes support feet that are horizontally strapped together to form a load supporting pallet of standardized size, said strapping being severable to provide aliquot portions of a vertical load supported on the aliquot portions of the supporting pallet.

In one embodiment of the invention the members forming the load bearing face extend beyond the vertical spacers or stringers of the pallet segment on one side of the segment to enable such segment to be lifted and moved by existing fork lift equipment having lift members constructed and spaced apart, so as to pick up and move a standard dimension whole pallet assembly.

BRIEF DESCRIPTION OF THE DRAWINGS

FIG. 1 is a perspective view showing a pallet of this invention formed of two aliquot portions with support leg elements abuttingly secured to each other to form a pallet of standard size;

FIG. 2 is a perspective view of one of the two portions of the standard sized pallet shown in FIG. 1;

FIG. 3 is a perspective view showing a modified form of the pallet of FIG. 1 wherein the interconnection between the portions of the pallet is effected through use of vertically extending dovetailed elements formed on adjacent support legs for two pallet segments;

FIG. 4 is a perspective view showing the two sections of the pallet of FIG. 3 separated to show details of the dovetailing elements on the support legs of the pallet segments;

FIG. 5 is a perspective view showing another alternative dovetailing structure for mutually interengaging two aliquot portions of a pallet;

FIG. 6 is a perspective view of a second alternative embodiment of the invention in which two aliquot portions of a standard sized pallet are supportingly clipped together to form a pallet of standard dimensions;

FIG. 7 is a perspective view similar to FIG. 6, showing still another alternative means of assemblying two aliquot portions of a pallet that are supportingly banded together;

FIG. 8 is a perspective exploded view of two aliquot portions of a pallet positioned and structured to joiningly coact with a single base member to form a pallet of a standard dimension;

FIG. 9 is a fragmentary view in perspective of a pallet construction as shown in FIG. 8, but in which the pallet portions bear a load and are each adapted to be removably engaged with the base member by vertical banding;

DETAILED DESCRIPTION OF THE INVENTION

Figure 10:
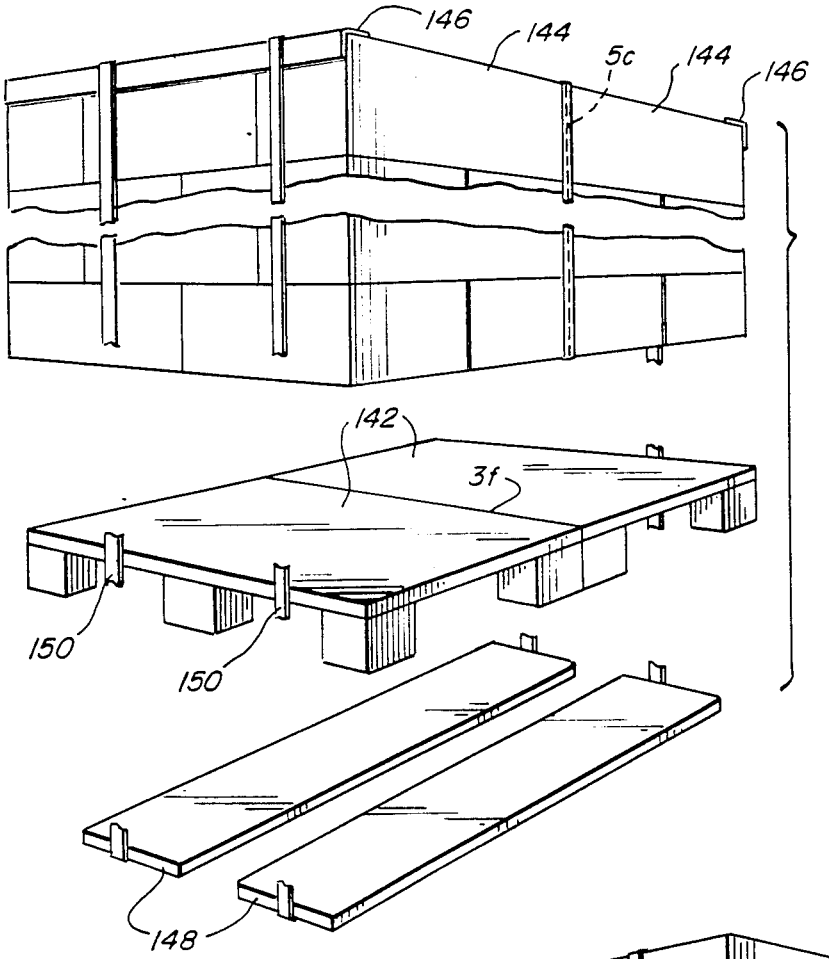
FIG. 10 is an exploded perspective view showing aliquot portions of a cargo comprised of a multiplicity of individual cartons positioned for placement on aliquot portions of a pallet and supportedly banded together to form a pallet and load of a standard dimension.

FIG. 1 shows in a perspective view a cargo support pallet assembly 2 formed of two substantially identical aliquot or half portions 4 and joined together at two abutting edge portions forming a split line, 3*a*, to form a substantially rigid product support pallet of a standard dimension, such as, for example, a pallet having a cargo bearing face or surface of 40 inches by 48 inches.

As best shown in FIG. 2, each aliquot portion, such as the half portion 4 shown, is comprised of a substantially planar cargo bearing surface, such as the surface formed by the upward facing surfaces of each of a plurality of support members, such as slats or boards 6.

The boards 6 are supported by appropriate means, such as cross member 11 which extends transverse to the boards 6 substantially midway between the opposite end portions 12 and 14 of the boards, as shown.

A supportive spacing means, such as a first plurality of leg members 16 (of which only one is seen in FIG. 2) and a second plurality of leg members 18 are engaged through members 10 to traverse support members 6. Optionally, transverse members 11, as shown in FIGS. 1 and 2, may also be provided to engage the underside of multiple boards 6 at a region intermediate the lateral ends of the transverse and 14 of boards 6. The members 16 and 18 maintain the members 6 in a spaced relationship above a surface on which the pallet is supported. This space enables the tines or lift members of a conventional pallet manipulator, such as a fork lift truck, to be selectively received by and removed from a lifting relationship with the pallet and any cargo which may be borne by it.

To enhance the structural integrity of legs 16 and 18 and aid in maintaining their preferred spaced relationship with respect to each other a plurality of cross support members, such as boards 20, are engaged with the lower terminal ends of each leg set including a leg 16 and a leg 18.

The structure shown in FIGS. 1 and 2 may be, as indicated on the drawings, formed of wood. The members 20 are preferably nailed or glued to the bottom portion of each pair of laterally spaced leg 16 and leg 18. One of the support members 10 is nailed or glued to the top terminal ends of the legs 16 and another of the support members 10 is nailed or glued to the top terminal ends of the legs 18. The cargo bearing boards are appropriately affixed, such as by nailing or gluing, to the support members 10 to complete the assembly of the aliquot, or one-half, portion segment of the pallet.

Placing two of the segments 4, each having for example, a cargo bearing face of 24 inches length between ends 12 and 14 of members 6, and 40 inches in a dimension transverse to elongated boards 6, with their 40 inch edges abutting each other to form the split line 3*a*, as shown in FIG. 1, provides a standard cargo bearing face of, in this example, 48 inches by 40 inches.

Each of the two pallet segments 4 are separately, or separably connected to each other to enable the assembly 2 to be loaded with and bear a divisible or splittable cargo of a standard size, such as a pair of predesigned and arranged consumer product displays, during shipment from a factory or warehouse to a point of sale, such as a retailer, where, upon arrival, the pallet segments and cargo can be readily separated along and upwardly of split line 3*a* into two complete product displays to enable the retailer to either reserve half a pallet of the delivered goods or, at his convenience, handle and display half a pallet of the goods.

To this end the pallet segments are affixed to each other with a first connective or engagement means, such as a first band 22, which is positioned to encircle and tightly engage the two sets of abutting legs 16 and 18 adjacent the split line 3*a* between the two pallet segments. Band 22 may be of the high tensile strength metallic type flexible in one plane and readily wrapped tightly around the two sets of legs 16 and 18 and joined securely together at its overlapping ends by appropriate clip means 23, using well-known commercially available equipment. Band 22 is preferably placed, as shown, in a position intermediate the upper and lower ends of the two sets of legs 16 and 18 that it binds together.

A second connective or engaging means, such as a second band 24, preferably similar to the band 22, is positioned to substantially encircle and tightly engage the three outer peripheral non-abutted edges or sides of each of the abutted aliquot segments 4. Band 24 is, as shown in FIG. 1, preferably placed in contact with the outermost sets of legs 16 of one pallet segment 4 and the outermost set of legs 18 of the adjacent pallet segment 4, in the plane of, or below the boards, 6 as seen in the assembled view in FIG. 1, and to be maintained tightly engaged with a clip means 26. Placement of the band 24 in this position does not reduce the spaced relationship between the members 6 and any support surface on which assembly 2 may be placed. Each of the bands 22 and 24 are positioned beneath, or in a non-interfering position with respect to, the load bearing face of the pallet assembly. Having the two aliquot segments 4 banded together, as described above and as shown in the drawings, provides a durable, substantially rigid pallet of a standard size which may readily be reduced to one half size at the point of delivery or display merely by severing both bands 22 and 24 using commonly available and well-known severing means, such as metal shears. Normally an aliquot portion of a splittable cargo would be borne by each pallet segment and maintained on each segment by means, such as by using a corrugated paper cover or envelope, or more likely, a plastic shrink wrap which protectively covers the sub-section of cargo and maintains it on its respective pallet segment.

FIGS. 3, 4 and 5 show alternative embodiments of the splitable pallet assembly shown in FIGS. 1 and 2.

In FIG. 3 the pallet assembly 30, having a slit line 3*b* between abutting edges, is formed of two pallet segments 32 in which the first connective means is formed directly on abutting legs 34. A second connective means, such as an encircling band 36, surrounds and tightly engages the exterior edge portions of each pallet segment operating to maintain the pallet segments together as a standard size pallet assembly, substantially as shown in FIG. 3. Preferably, a retaining means, such as a band receiving recess 38, is provided in the exterior edge portions of the deck segments of the pallet segments to maintain the pallet segments as a unitary assembly 30. A clip means 37 serves to fixedly engage two overlapped end portions of band 36 to maintain the band tightly engaged with the exterior edge portions of each of the two pallet segments.

FIG. 4 shows two vertically offset pallet segments 32 having a first connective means formed on a plurality of abutting legs 34 and comprised of mutually interengaging vertically extending, tongue-and-groove, recesses 40 and projections 42 which slide together vertically to help maintain the deck portions of the pallet segments 32 joined together to form the pallet assembly 30.

FIG. 5 shows two horizontally offset pallet segments 32' having a first connective means formed on a plurality of abutting legs 34' and comprised of mutually interengaging horizontally extending recesses 44 and projections 46 which slide together horizontally to maintain the pallet segments joined to form an assembly corresponding with assembly 30 as seen in FIG. 3.

It will be understood that although the deck segments and support legs therefor may be formed separately and secured together to form the half pallet segments shown in FIGS. 3–5, it is also possible to integrally mold each half pallet segment and its respective support legs, including those legs with interengaging elements as described.

FIG. 6 is a perspective view of a pallet assembly 70 formed from two half portions or segments 72. Each of the segments 72 includes a load bearing deck member 74 provided with appropriate support and spacing means such as legs 76, for supportedly spacing deck member 74 above a support surface, such as a floor.

Supportive engaging means, such as a pair of elongated rigid members or boards 78, are positioned adjacent the downward facing or lower surface, of each of the load bearing deck members 74 and extends the combined width of both segments 72. As shown, the boards 78 extend substantially transverse to a split line 3*c* formed by the abutting edges of the pallet segments. External edge portions of the load bearing deck members 74 and the ends of the elongated rigidifying members 78 are substantially co-terminal, as illustrated by part of the assemblage in FIG. 6. A readily installable and removable connective, or clip, member, such as U-shaped clips 80, are dimensioned to clip onto and over edge portions of deck members 74 and rigidifying members 78 to receive the combined thickness of the two members 74 and 78 in a resilient manner while being frictionally engaged with each of the members embraced when the bight, or connective portion, of each of the clips is forced axially, as indicated by the directional arrows, into position to hold together a deck segment 72 and a rigidifying member 78 as shown in FIG. 6.

The segments 72 are readily separable along the pallet's split line 3*c* by removing the clips 80 to separate the rigidifying members 78 from the deck segments 72 of the two pallet sections.

FIG. 7 shows a pallet and cargo assembly 90 comprised of a pair of pallet segments 92 and a pair of cargo segments 104, which are partially shown. Pallet segments 92 are substantially equivalent to the pallet segments 72 of FIG. 6. The pallet segments 92 have a pair of abutting edge portions which form a split line 3*d*. A supportive engaging means, such as a pair of inverted U-shaped angle irons 94 are positioned beneath the load bearing members and oriented substantially transverse to split line 3*d*, substantially as shown. A securing means which is readily installable and removable, such as a pair of retaining bands, of which one band 106 is shown, are each positioned beneath the bight of the channel iron and extend upwardly and over the top of a divisible cargo 104 (partially shown) comprised of two cargo segments having a split line 5*a*. Each of the pair of bands 106 is positioned and arranged to maintain the load bearing faces compressed between a U-shaped member and the cargo to maintain the cargo segments, the pallet segments and the elongated channel irons as a standard dimension pallet and cargo assembly.

FIG. 8 shows in an expanded perspective view another embodiment of the invention in which a base member 110 of a desired standard dimension is adapted to supportingly receive two aliquot segments 112 of a standard dimensioned cargo bearing member.

Base member 110 is formed of appropriate spacing and supporting means, such as stringers 114 having fork, lift tine receiving cut outs 116. A plurality of cross support members, such as boards 118, are affixed to bottom surfaces of stringers 114 to maintain the stringers as a substantially rigid subassembly having a desired spaced relationship between the stringers. Each of the aliquot segments 112 of the cargo bearing members are provided with a rigidifying locating and spacing means, such as members 120, which coact with upper portions of stringers 116 to aid in maintaining the members 112 properly located on the base.

As best shown in FIG. 9, a cargo, such as one segment of a pair of a half pallet load segments 122 (partially shown) is placed on each of the two pallet segments 112 positioned on base 110. A cargo split line 5*b* (see FIG. 9) is formed by the abutting edges of the two cargo segments, and a pallet split line 3*e* is formed by the abutting edges of the pallet segments. An appropriate selectively installable and removable securing means, such as a pair of metallic bands 126, are then positioned to each encircle one section of the split cargo and a portion of the base, preferably in the cut outs 116, as shown, and tightened and engaged to form a load binding loop which maintains the cargo segments or containers 122, the pallet segments 112 and the support base 110 as a loaded pallet assembly of a standard size.

Severing a band 126 encircling a container 122 enables that container 122 and the aliquot segments 112 supporting it to be picked up by a fork lift and, dividing along split lines 5*b* and 3*e*, to be removed from base 110 separate from the other container 122. The members 120 on lower surface of each segment 112 allow the segment to be moved to a location with a container on it and positioned at a desired location, such as on a floor in an aisle of a retail store for product display and sale from the pallet segment or for shelf stocking. Due to the spacing provided by members 120 between the lower surface of the load bearing face of member 112 and a floor (not shown) the pallet segment and container or cargo can be lowered to rest on the floor on the lower surfaces of the members 120 and the fork lift tines can be withdrawn from beneath the pallet segment.

Figure 11:
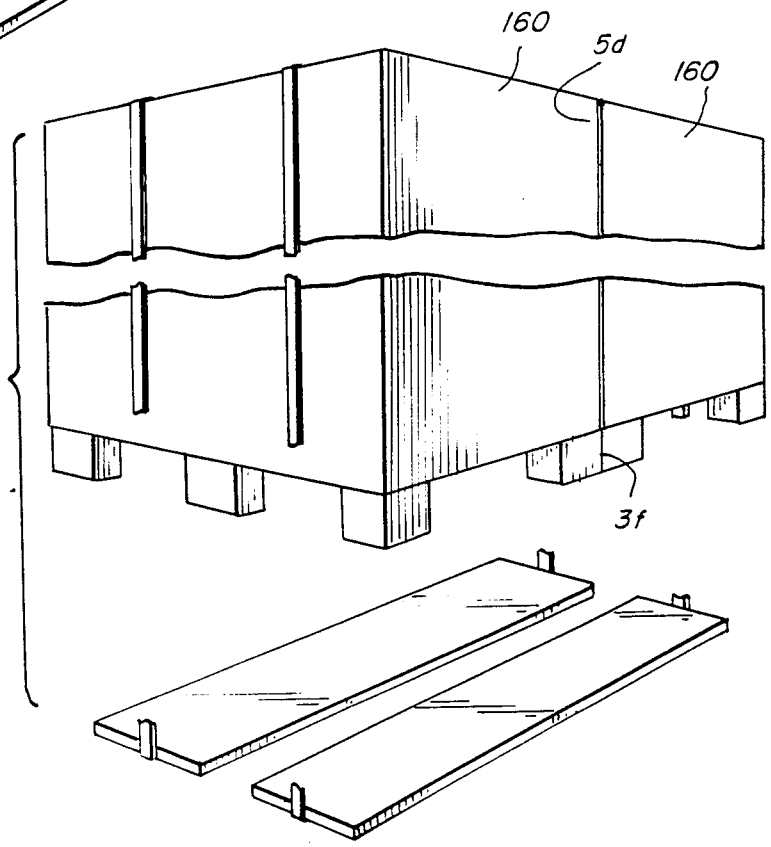
FIG. 11 is an exploded perspective view showing two container type pallet portions adapted to be supportingly banded together to form a separable pallet and cargo having a standard dimension.

FIGS. 10 and 11 show in exploded perspective views two additional embodiments of pallet segments and cargo segments supportively engaged to form standard size pallet and cargo units.

FIG. 10 shows a pair of pallet segments 142 having abutting edges for forming a split line 3*f*. A pair of cargo segments 144 are loaded on, or borne by, the pallet segments. The cargo segments have a split or divisible line 5*c* formed at their abutting edges. Each cargo segment is comprised of a plurality of cartons or containers selectively stacked on a pallet segment 142. Upper corner support means, such as elongated and angled cardboard abutment members 146, may be positioned at the upper external edge of each cargo segment, substantially as shown.

An engaging means, such as a pair of elongated boards 148 are positioned beneath the load bearing members of the pallet segments and a selectively installable and removable securing means, such as the pair of retaining bands 150, are each positioned to longitudinally encircle the boards and the pallet segments, substantially as shown. The bands 150 are tightened and fastened to maintain the pallet segments and cargo segments as a transportable standard sized unit which may be readily divisible by severing the bands.

The pallet and cargo assembly illustrated in FIG. 11 is identical to that shown in FIG. 10 except the cargo segments 160 are each formed as a unitary container borne by support legs. The abutting surfaces of cargo segments 160 form a dividing or split line 5*d* which extends vertically above split line 3*f* formed by the abutting surfaces of the legs of the pallet segments.

Figure 12:
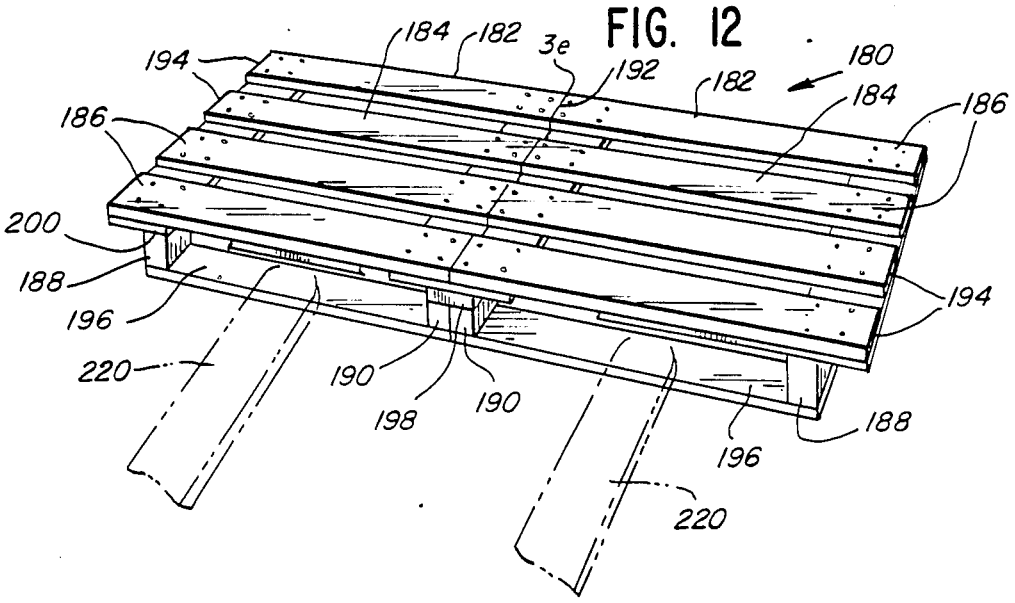
FIG. 12 is a perspective view showing an alternate embodiment of a standard size pallet assembly formed of two abutted segments in which each segment has a portion of the load bearing face which extends beyond, or overhangs, a vertical spacer or stringer of the pallet segment.
Figure 13:
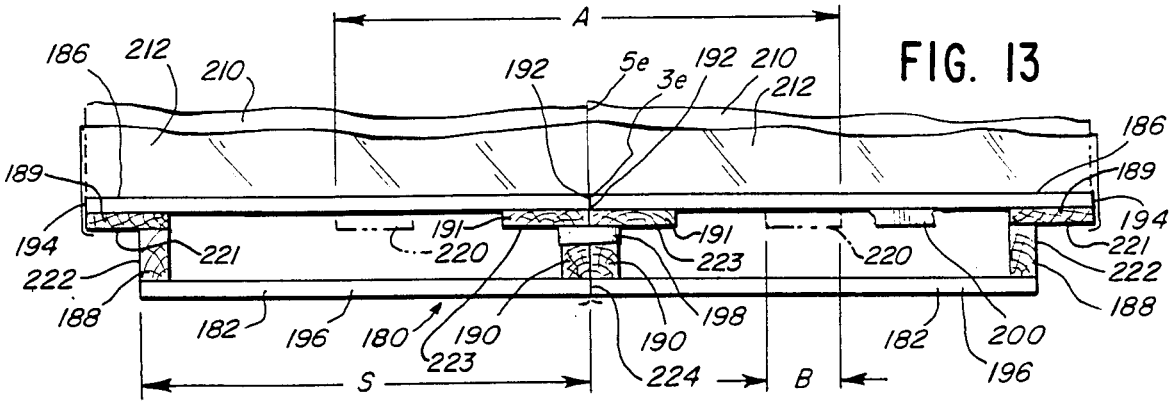
FIG. 13 is a front elevation view of the engaged pallet segments shown in FIG. 12.

FIG. 12 shows in a perspective view a standard sized pallet assemblage 180 formed of two substantially identical pallet segments 182 and FIG. 13 is a front elevation view of the pallet assemblage 180 shown in FIG. 12. Each of the pallet segments 182 has a load bearing face 184 formed of a suitable load bearing material, such as a plurality of spaced parallel boards 186. Boards 186 are affixed to a suitable vertical spacer leg means 188 and 190 having respectively an elongated bridging member 189 and 191 (see FIG. 13) extending across the top of the spacer leg means to provide a support surface for the boards 186.

The boards 186 of each pallet each have a first end 192 which is substantially co-terminal with the abutting sides of the spacer leg means 190, and a second end 194 which extend laterally outwardly beyond the spacer leg 188 to overhang the spacer leg means 188. The ends 192 are placed substantially in the abutted relationship shown in FIG. 12 to form a standard pallet assembly having a separation or split line 3*e*.

A plurality of strengthening members 196 may be affixed to the bottom of the spacer leg means 188 and 190. A selectively appliable and removable, or severable, engagement means, such as a metal or plastic strap 198 encircles and tightly engages the adjacent or abutting spacer leg means 190. A second engagement means, such as a metal or plastic strap 200, encircles each pallet segment 182 along their external edges below the load bearing face 184. The two straps 198 and 200 maintain the pallet segments 182 as a pallet assembly 180 having a load bearing face of, for example, forty-eight inches in width by forty inches in depth. This pallet assembly 180 can be loaded with two separable cargoes, such as preformed displays, as shown for the pallet assemblies shown in FIGS. 7, 9, 10 and 11. As shown in elevation in FIG. 13, two separate cargo assemblies 210, or equal subdivisions of a load, may be constructed to engage each pallet segment by suitable means, such as by a shrink wrap membrane 212, or, alternatively, a corrugated cardboard covering, or by being encircled in substantially a vertical plane to be maintained engaged with the pallet. A cargo separation or split line 5*e* is provided substantially co-planar with the pallet segment split line 3*e*, whereby upon loading and shipping pallet assembly 180, there will be two discrete cargo segments 210 affixed on it. The pallet assembly may be picked up by typical spaced fork lift or hand truck load support members 220, shown in phantom, and then moved from the conveyance vehicle to a storage floor.

Figure 14:
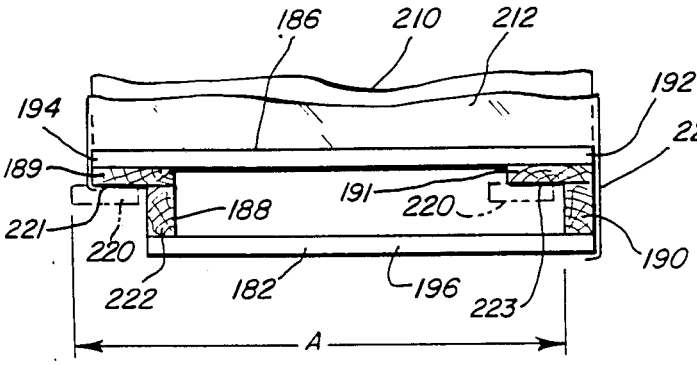
FIG. 14 is a front elevation view of one of the pallet segments shown separate from the assembled relationship shown in FIGS. 12 and 13.

The bands 198 and 200 may then be removed, such as by severing them, to provide two separate, laterally mirror image pallet and cargo assemblies such as 182 shown abutting each other as seen in FIG. 13, or where only one such pallet is shown in FIG. 14. Horizontal support members 186 are sized to have a length between ends 192 and 194, in this example, of about 24 inches; and the distance between the outside edges 222 and 224, respectively, of the spacer means 188 and 190, as defined by dimension S, would be about 21 inches. Therefore, the members 186 extend about 3 inches beyond the outside edge 222 of the vertical spacer leg means 188 to terminate at ends 194. Member 189 extends beyond edge 222 and provides a lower surface 221 and member 191 provides a lower surface 223. The lateral size of such boards 189 and 191 is such that they extend in the same direction relative to spacer legs 188 and 190 to provide support surfaces 221 and 223 that are adapted to be engaged by the upper surfaces of fork lift members, such as 220, substantially as shown in FIG. 14.

As shown in FIG. 14, this extension or overhang portion enables a pair of lift members adjusted to a normal dimension A between outside edges of, in the example shown, 27 inches with each of the lift members having a width B of about 6½ inches to liftingly engage the pallet and cargo segment 182, 210 whereby the pallet may be lifted up and moved with the lift members 220 in substantially the position shown in FIG. 14.

In the specific example given the load bearing face of each pallet segment of FIG. 14 would be 24 inches by 40 inches to provide a pallet assembly, as shown in FIGS. 12 and 13 having a load bearing face of about 48 inches by 40 inches. Upon having the benefit of this disclosure various other dimensional variations to practice this invention may occur to those skilled in the art.

In each of the embodiments described above the first connective means, such as the band 22 of FIG. 1, the projections 42 and recesses 40 of FIG. 4, the projections 46 and the recesses 44 of FIG. 5, and the supportive engaging means comprised of the members 78 of FIG. 6, the members 94 of FIG. 7, the stringers 114 of FIGS. 8 and 9 and the members 148 and 148' of FIGS. 10 and 11, respectively, all engage the pallet segments beneath the load bearing face and therefore do not reduce the useful area of the load bearing face nor in any other way reduce its utility.

Also, in each of the embodiments disclosed herein the cargo segment may be engaged with the pallet segment by appropriate protective engaging means, such as a protective corrugated paper cover or a plastic cover, such as heat shrinkable plastic, which covers the cargo and is affixed to the pallet segments by appropriate means such as nails, glue or being shrunk fit over the pallet segment, to maintain the cargo segment on the pallet segment and protect the cargo from damage during transit or storage. Such loaded and covered pallet segments can then be formed into the above disclosed divisible unitized pallet assemblies for shipment and storage.

While a particular embodiment of this invention has been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a product transport pallet assembly having a load bearing face of standard dimensions; an improved product support pallet comprising, in combination:

a plurality of discrete pallet segments each having an upwardly facing, load bearing surface, and an opposite downwardly facing surface, each of said pallet segments providing an aliquot portion of the pallet's load bearing face of standard dimensions;

each of said discrete pallet segments having leg means extending therebelow for providing a member-receiving space between said downwardly facing surface and a planar surface upon which said transport pallet assembly is to be supported by said leg means;

each of said segments further having at least one abutting edge portion for abutting an adjacent pallet segment to form a straight split line, that lies in a vertical plane between adjacent edges of a pair of abutting pallet segments, and an external edge portion on each pallet segments spaced from said abutting edge portion;

means for supportively engaging a pair of discrete pallet segments, said supportively engaging means including at least one elongated rigidifying member positioned beneath and against the downwardly facing surface of said load bearing faces of abutting pallet segments, and extending substantially transversely to said abutting edge portions that define said split line;

said means for supportively engaging a pair of discrete, adjacent, pallet segments providing two opposite end edges, each of which is located substantially co-terminal with an external edge portion of one of the pallet segments; and selectively installable and removable holding means, for selectively engaging and securing each of the ends of said elongated rigidifying member to an adjacent pallet segment for maintaining said pair of adjacent pallet segments as a substantially rigid pallet assembly.

2. A construction as in claim 1 in which said removable holding means includes a plurality of clip members each of which is adapted to engage and hold an end portion of said rigid member to an adjacent co-terminal end portion of a pallet segment.

3. A construction as in claim 2 wherein said means for supportively engaging a pair of discrete adjacent pallet segments includes a pair of laterally spaced elongated boards each extending transversely to the split line, and each of said clip members being a substantially U-shaped metal clip adapted to be slid onto an end portion of each board and onto an adjacent edge of a pallet segment for maintaining and holding said boards and said pallet segments together as a pallet assembly.

4. A construction as set out in claim 1 together with a cargo of a standard dimension that is divided into aliquot segments, said cargo segments each being positioned on one aliquot load bearing face of a pallet segment, with each of said aliquot cargo segments being borne by only one pallet segment that is an aliquot portion of a pallet of standard dimension.

5. A construction as set forth in claim 4 together with covering means for separately enveloping, and holding each aliquot cargo segment to the pallet segment by which it is borne, for forming multiple unit sub-assemblies of a pallet, each with a load thereon.

6. A construction as set forth in claim 5 wherein the cargo loading on a pallet segment does not extend laterally past a vertical plane that is an extension of said straight split line between abutting edge portions of the pallet's segments.

7. A construction as set forth in claim 4 together with a selectively installable, severable banding means, which embraces a cargo segment on a pallet segment, and which also holds an elongated rigid member in position abutting the underside of the load bearing face of at least one pallet segment.

8. An improved product transport pallet assembly having a load bearing face and comprising, in combination:

a plurality of discrete pallet segments which, when assembled together, define the product transport pallet assembly;

each discrete pallet segment having an upwardly facing, load bearing surface, and an opposite and downwardly facing lower surface, each of said pallet segments constituting an aliquot portion of the pallet assembly's load bearing face;

each of said pallet segments having a plurality of edges, at least one edge being an abutting edge portion, for abutting an edge of an adjacent pallet segment to form only a continuous straight split line that lies in a vertical plane defined between said adjacent abutting edges of each of abutting pallet segments;

each pallet segment having, adjacent its edges, a plurality of supportive leg means extending downwardly from the downwardly facing surface of the pallet segment, for spacing the load bearing surface of the pallet segment above a support surface for the product transport pallet assembly, some of the support leg means for each pallet segment being located adjacent said split line that lies in a vertical plane and also being located adjacent to and abutting leg means of an adjacent pallet segment; and a first severable connective banding means, located below the load bearing surfaces of a pair of adjacent one of said pallet segments, said first connective banding means being wrapped only around abutting ones of said supportive leg means for holding said supportive and abutting leg means of said adjacent, abutting, pallet segments together along the straight split line therebetween, and a second, severable, connective banding means located spaced below the load bearing surfaces of each of the pair of adjacent, abutting, pallet segments, but being located in a different horizontal plane than said first connective banding means, and being wrapped around the exterior periphery of all exterior ones of said supportive leg means of the pair of adjacent, abutting, pallet segments, whereby to hold said pair of pallet segments together, but permitting selective separation of the pair of pallet segments along said split line by severing said first and second connective banding means that hold said adjacent pair of pallet segments together along the split line.

9. An improved product transport pallet assembly having a load bearing face and comprising, in combination:

a plurality of discrete pallet segments which, when assembled together, define the product transport pallet assembly;

each discrete pallet segment having an upwardly facing, load bearing surface, and an opposite and downwardly facing lower surface, each of said pallet segments providing an aliquot portion of the pallet assembly's load bearing face;

each of said pallet segments having a plurality of edges, at least one edge being an abutting edge portion, for abutting an edge of an adjacent pallet segment to form a continuous, straight split line that lies in a vertical plane between said adjacent abutting edges of each pair of abutting pallet segments;

each pallet segment having, adjacent its edges, a plurality of support leg means extending downwardly from the downwardly facing surface of the pallet segment, for spacing the load bearing surface of the pallet segment above a support surface for the product transport pallet assembly, some of the support leg means for each pallet segment being located adjacent said split line and also being located adjacent to and abutting the support leg means of an adjacent pallet segment;

severable connective banding means, located below the load bearing members of a pair of adjacent pallet segments, for holding the supportive leg means of two adjacent pallet segments together along the straight split line therebetween, whereby to hold pairs of pallet segments together, but permitting selective separation of the pairs of pallet segments along said split line by severing the connective banding means that hold adjacent pairs of pallet segments together along the split line; and the severable connective banding means including an elongated first flexible band positioned to encircle and tightly engage the sets of legs of the two pallet segments that are positioned adjacent each other, but are located on opposite sides of, said split line; and the separable connective means being located in a plane intermediate the upper and lower ends of the two sets of legs that are bound together thereby.

10. A construction as in claim 9 including an elongated, severable second connective banding means, in the form of a severable, flexible, second band that is of an operative length greater than the length of the first flexible band, and is so positioned, as to substantially encircle and tightly engage support legs for the pair of adjacent, abutted, pallet segments that are located adjacent the peripheral non-abutted edges of said pair of abutted aliquot pallet segments.

11. A construction as in claim 9 including a separate envelope means for protectively covering a sub-section of cargo that is supported on each respective pallet segment.

* * * * *